US008500056B1

(12) United States Patent
Slezak

(10) Patent No.: US 8,500,056 B1
(45) Date of Patent: Aug. 6, 2013

(54) SELF-COMPENSATING FILAMENT TENSION CONTROL DEVICE WITH EDDY CURRENT BRAKING

(75) Inventor: Raymond J. Slezak, Barberton, OH (US)

(73) Assignee: RJS Corporation, Akron, OH (US)

( * ) Notice: Subject to any disclaimer, the term of this patent is extended or adjusted under 35 U.S.C. 154(b) by 0 days.

(21) Appl. No.: 13/518,902

(22) PCT Filed: Oct. 1, 2010

(86) PCT No.: PCT/US2010/051058

§ 371 (c)(1),
(2), (4) Date: Jun. 25, 2012

(87) PCT Pub. No.: WO2012/044322

PCT Pub. Date: Apr. 5, 2012

(51) Int. Cl.
*B65H 59/04* (2006.01)

(52) U.S. Cl.
USPC .... 242/419.3; 242/421; 242/423; 242/147 M; 242/156.2

(58) Field of Classification Search
USPC ..... 242/410, 416, 419, 419.3, 421, 422, 242/422.2, 422.4, 422.9, 423–423.2, 147 R, 242/147 M, 155 R, 155 M, 156, 156.2
See application file for complete search history.

(56) References Cited

U.S. PATENT DOCUMENTS

| | | | | |
|---|---|---|---|---|
| 3,540,675 | A | 11/1970 | Goldworthy | 242/156.2 |
| 3,899,143 | A | 8/1975 | Slezak | 242/156.2 |
| 4,004,750 | A | 1/1977 | Seagrave, Jr. | 242/75.43 |

FOREIGN PATENT DOCUMENTS

| | | | |
|---|---|---|---|
| JP | 60048872 | | 3/1985 |
| WO | WO 02/00540 | A2 | 1/2002 |
| WO | WO 2008/138318 | A1 | 11/2008 |

OTHER PUBLICATIONS

International Search Report mailed Jun. 24, 2011 in corresponding application No. PCT/US2010/051058.

*Primary Examiner* — William E Dondero
(74) *Attorney, Agent, or Firm* — Renner Kenner Greive Bobak Taylor & Weber

(57) ABSTRACT

A self-compensating tension control device for regulating the payout of filamentary material from a spool includes a fixed support and a spindle assembly rotatably carrying the spool. A tension force applied to the filamentary material, in opposition to a biasing force, moves the spindle assembly linearly in relation to the fixed support. An eddy current braking system includes a conductive member rotatable with the spindle assembly and a magnetic member carried by the fixed support. The spindle assembly and the conductive member move linearly toward a side-by-side relationship with the magnetic member when the tension force applied to the filamentary material is reduced and unable to overcome the biasing force. Linear movement of the spindle assembly and the associated conductive member can be obtained by either a straight line mechanism or a linear ball bushing mechanism. A supplemental brake may also be used.

15 Claims, 12 Drawing Sheets

SELF-COMPENSATING FILAMENT TENSION CONTROL DEVICE WITH EDDY CURRENT BRAKING

CROSS-REFERENCE TO RELATED APPLICATION

This is a §371 application of International patent application number PCT/US2010/051058 filed Oct. 1, 2010, and which is incorporated herein by reference.

TECHNICAL FIELD

The present invention relates generally to an automatic tension control device for regulating the amount of tension under which a filamentary material is withdrawn from a spool. More particularly, the present invention relates to such a tension control device which tends to maintain substantially constant tension in filamentary materials over variances in operating parameters. More specifically, the present invention relates to such a tension control device which employs a laterally movable spindle carriage operative with a circular eddy current brake, thereby tending to maintain substantially constant tension in the filament.

BACKGROUND ART

Filamentary materials include fibers in single and multiple strands, flat bands, or tubing produced in long lengths and conveniently wound on spools. The various filamentary materials may be either natural or synthetic fibers, glass or metal. Such materials are commonly utilized as reinforcements for plastic or elastomeric compounds or may themselves be fabricated into integral items as in the textile industry or the tire industry. Regardless of the application, it is customary to withdraw the filamentary material from the spool at or near the location it is being used. To facilitate such removal, the spool is customarily mounted on a spindle or let-off device which permits the spool to rotate as the filament is withdrawn.

A main function of a tension control device is to provide a uniform tension of the filament as it is withdrawn from the spool. This requirement applies also when the weight and diameter of the filament wound upon the spool decreases as the filament is consumed, and/or if the speed of withdrawal is changed. Furthermore, it is necessary that in a system employing multiple tension control devices that the withdrawal tension be substantially uniform among all devices. Another function of the device is to apply additional tension (or braking) when withdrawal is stopped, thereby minimizing unraveling of the filament on the spool because of the momentum of spool and its content. Such braking, in the stopped condition, also may serve to keep the spindle rotationally stable during loading of spools thereon.

Numerous braking devices have been developed for use with creels. Many of these provide for the filament to be payed out under tension greater than what is required for payout from the spool. As the tension decreases, with slack in the filament, the braking force is applied to slow the rotation of the spool. Further, the amount of tension to be maintained in the filament must be variable in order to accommodate operations with different filaments under various conditions. In the past, such creels having variable tension control have often required multiple individual adjustments and have not been desirably compact. Some designs have even required tension adjustments during payout of the filament, as the spool is emptied. In other instances, creels have exhibited undesirable hunting or loping in the form of periodic variations about a desired tension, particularly in high-tension applications.

One of the more commercially successful tension control devices used in the tire industry is in accordance with Applicant's U.S. Pat. No. 3,899,143. That device has a support structure which carries a spool support and a separately mounted rotatable pivot shaft. A first lever arm fixed on the pivot shaft carries a guide for tensioning the filamentary material as it is withdrawn from a spool mounted on the spool support and a brake which selectively engages the spool support. A second lever arm fixed on the pivot shaft is operatively connected with an air cylinder which effects a biasing that is transmitted to the first lever arm via the pivot shaft.

Tension control devices according to U.S. Pat. No. 3,899,143 have demonstrated exemplary operating characteristics under a variety of conditions and with a variety of filaments. However, there are several situations in which these tension control devices are not well suited. It has been found that the control arm and guide roller are vulnerable to damage from over-tension possibly caused by entanglement of the spooled material. In instances where the filamentary material is a heavy gauge wire, the guide roller imparts a "cast" or distortion to the shape of the wire. This may lead to a less than satisfactory end product or the need to provide additional manufacturing equipment to straighten the wire. To the present time, there has been no comprehensive device for adequately dispensing heavy filamentary material from a spool. Yet a third problem is that the control arm and roller inhibits closely mounting the multiple tension controllers on the creel assembly.

One way to overcome the foregoing problems associated with the prior art is to provide a tension control device in which the spool is carried by a pivotably mounted spindle assembly that is moveable with a pivotably mounted braking assembly as seen in U.S. Pat. No. 6,098,910. By utilizing a fixed cam that engages the braking assembly, the rotation of the spindle is inhibited whenever a predetermined tension force is absent from the filamentary material. The braking assembly is provided with a slidable block with cam bearings that are spring-biased against a curvilinear cam surface provided by the cam. This provides a gradual yet firm application or removal of a braking force depending upon the amount of tension applied to the filamentary material. The braking force, applied through the cam, adjusts in response to the varying tension of the material as it unwinds from the spool. An increasing tension accordingly acts on the pivotably mounted spindle assembly causing the braking force to be relieved by an increasing amount, thereby tending to keep the filament in constant tension; conversely, a decreasing tension causes a greater braking force to be applied, with full braking (within the limits of the device) at zero tension. Although an improvement in the art, the aforementioned tension control devices with a pivotably mounted spindle utilize a pendulum motion to provide displacement of the spindle and spool. However, such pendulum motion imparts the effect of gravity on the operating tension because the force from gravity varies according to the angular displacement. As a result, the force from gravity can be several times the desired tension output of the device.

It is also known in the art to use a magnetic eddy current brake to provide back tension of a spool from which filamentary material is withdrawn. In one known device, an eddy current disk rotates with the spool and a control arm is pivotally mounted near the spool. The filamentary material passes over a guide roller mounted to one end of the control arm. An opposite end of the control arm carries the magnetic material.

The tension in the filamentary material is defined over the force to pivot or move the control arm. The amount of this force can be adjusted by a pressurized diaphragm cylinder. If the filament's tension exceeds the control arm force, then the magnetic brake material moves away from the eddy current disk and the braking force on the spool is reduced. If the filament's tension is less than the control arm force and that of the diaphragm, then the magnetic brake material moves toward the eddy current disk and the braking force on the spool is increased. However, the use of a control arm has the problems previously mentioned of imparting distortion to the filamentary material, damaging the guide roller from over-tension and preventing such devices from being closely mounted to one another on the creel assembly.

In view of the shortcomings of the aforementioned devices, there remains a need in the art for a tension control device that minimizes the force from gravity while still providing the benefits of a device that does not employ a control arm and guide roller.

DISCLOSURE OF INVENTION

In light of the foregoing, it is a first aspect of the present invention to provide a self-compensating filament tension control device with eddy current braking.

Another aspect of the present invention is to provide a self-compensating tension control device for regulating the payout of filamentary material from a spool, comprising a fixed support, a spindle assembly carried by the fixed support, the spindle assembly rotatably carrying the spool of filamentary material, wherein a tension force applied to the filamentary material, in opposition to a biasing force, causes the spindle assembly to linearly move in relation to the fixed support, and an eddy current braking system comprising a conductive member rotatable with the spindle assembly and a magnetic member carried by the fixed support, the spindle assembly and conductive member moving linearly toward a side-by-side relationship with the magnetic member when the tension force applied to the filamentary material is reduced and unable to overcome the biasing force, and wherein payout of the filamentary material at a regulated rate occurs when the biasing force is balanced with the tension force.

BRIEF DESCRIPTION OF THE DRAWINGS

This and other features and advantages of the present invention will become better understood with regard to the following description, appended claims, and accompanying drawings wherein:

BEST MODE FOR CARRYING OUT THE INVENTION

Figure 1:
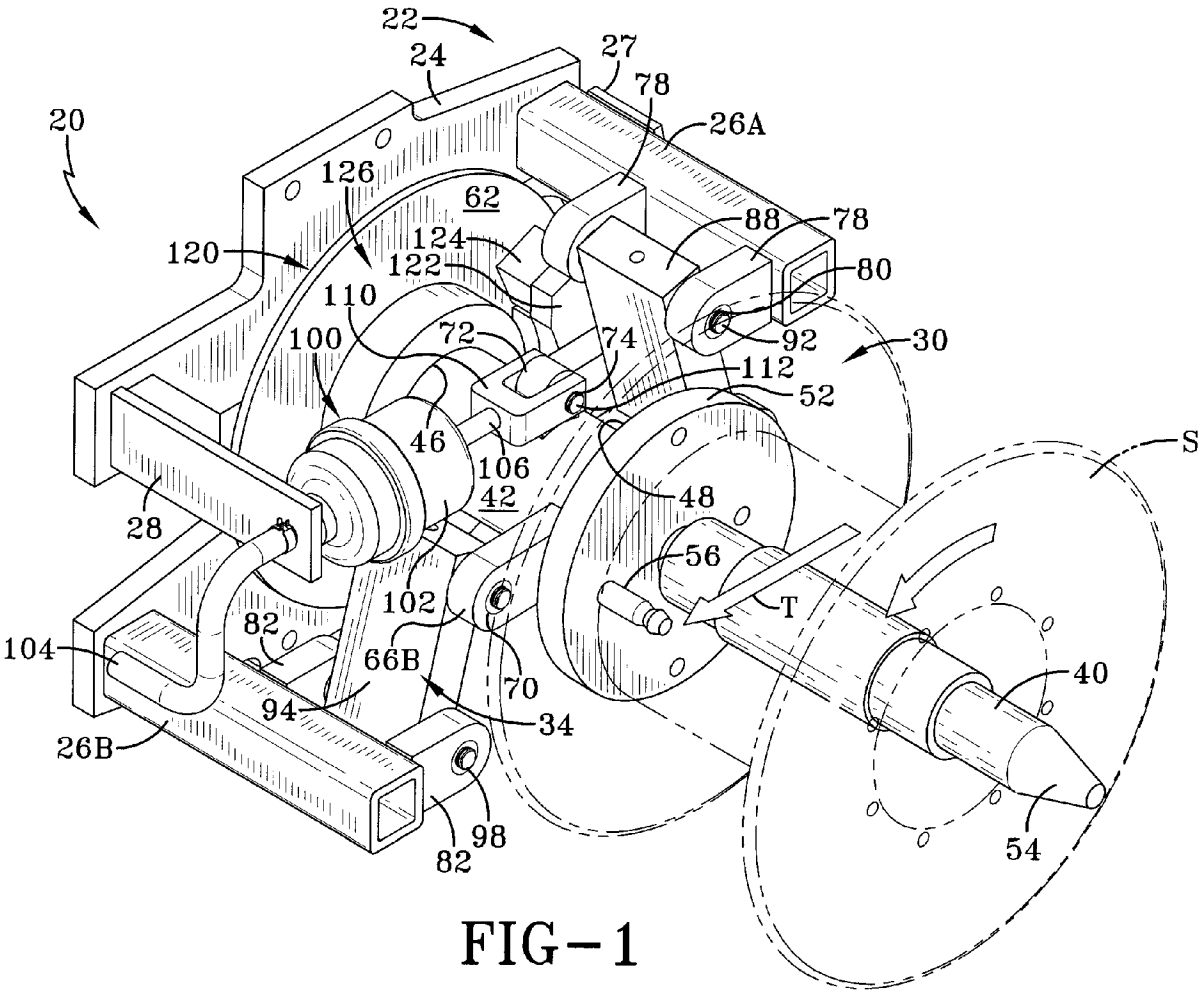
FIG. 1 is a front isometric view of a self-compensating filament tension control device with eddy current braking shown in a braking position embodying the concepts of the present invention, wherein a spool of filamentary material is shown in phantom and wherein the device controls withdrawal tension of the filamentary material.

An exemplary self-compensating filament tension control device with eddy current braking according to the concepts of the present invention is generally indicated by the numeral 20 as seen in FIGS. 1-5. The tension control device 20 includes a fixed support 22 that is affixed to or is part of a creel or other support structure which is part of a machine that processes individual strands of filamentary material into a finished manufactured item. It will be appreciated that the creel likely supports multiple devices 20 as needed. The fixed support 22 includes a support frame 24 which is mounted on the creel via bolts, welding or other secure attachment. The support frame 24 includes at least two support arms 26 extending substantially perpendicularly therefrom and wherein the support arms 26 are utilized to support or carry other components of the control device 20. The support arms 26 are further identified as an upper support arm 26A and a lower support arm 26B.

The fixed support 22 further includes a magnet support bracket 27 which extends perpendicularly and downwardly from the upper support arm 26A. A diaphragm bracket 28 extends perpendicularly and outwardly from the support frame 24 in the same direction as the support arms 26B.

A spindle assembly, designated generally by the numeral 30, is carried by the fixed support 22 in conjunction with a straight-line mechanism designated generally by the numeral 34. The interrelationship between the spindle assembly 30 and the straight line mechanism 34 will be discussed in detail as the description proceeds.

The spindle assembly 30 carries a spool S of filamentary material that is pulled so as to result in rotational movement of the spool. As shown in FIG. 1, the filamentary material is pulled to the left of the device, as designated by capital letter T, resulting in counter clockwise rotation of the spool S. In other words, tension (T) is applied to the filamentary material causing the spool to rotate. Skilled artisans will appreciate that the filament may be pulled off in the other direction resulting in clockwise rotation of the spool as long as appropriate modifications are made to components of the control device 20 to allow for such a configuration, or if the entire device is mounted upside down.

Figure 2:
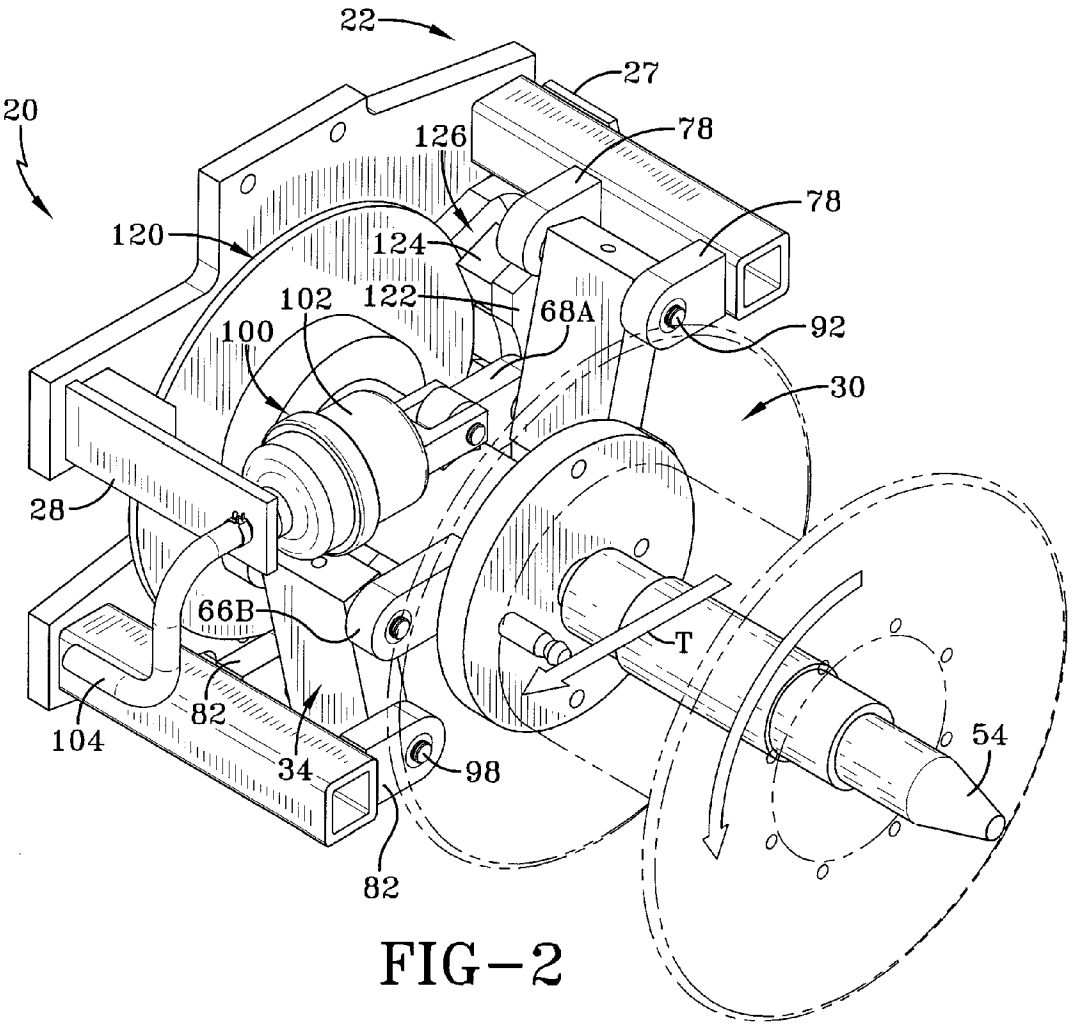
FIG. 2 is a front isometric view of the tension control device shown in a non-braking position.
Figure 3:
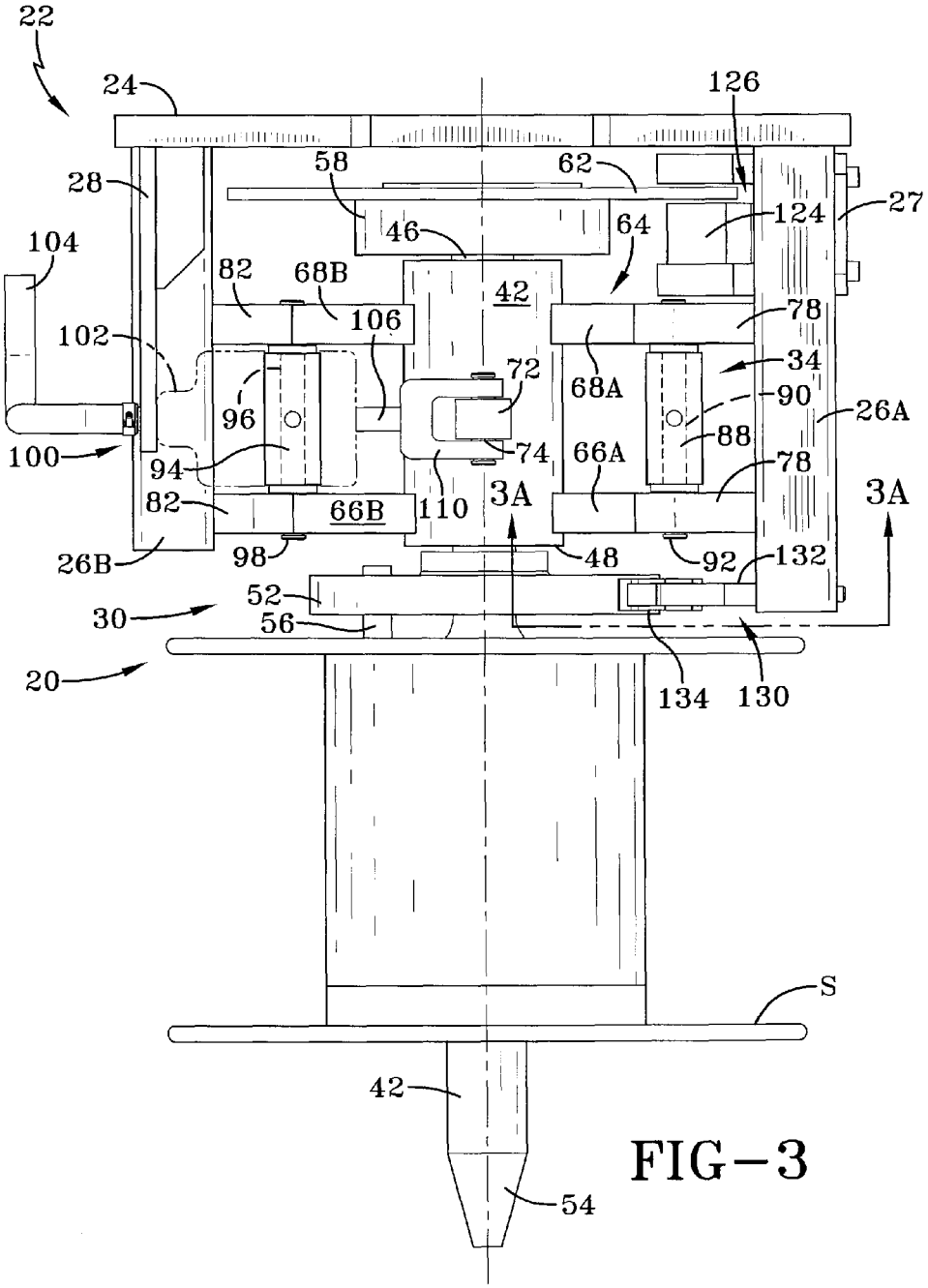
FIG. 3 is a top view of the tension control device which includes a supplemental brake.
Figure 4:
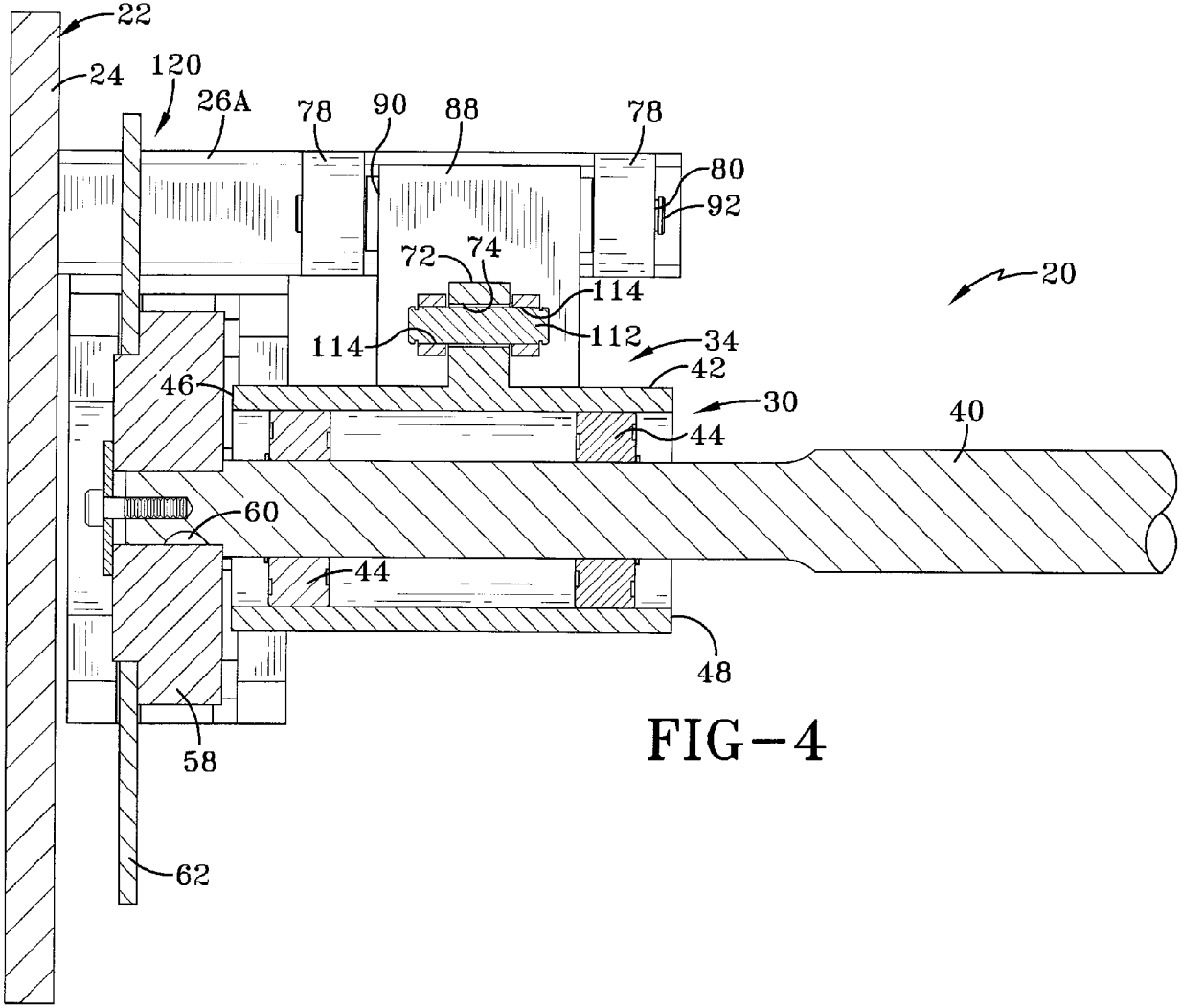
FIG. 4 is a partial cross-sectional view of the tension control device.
Figure 5:
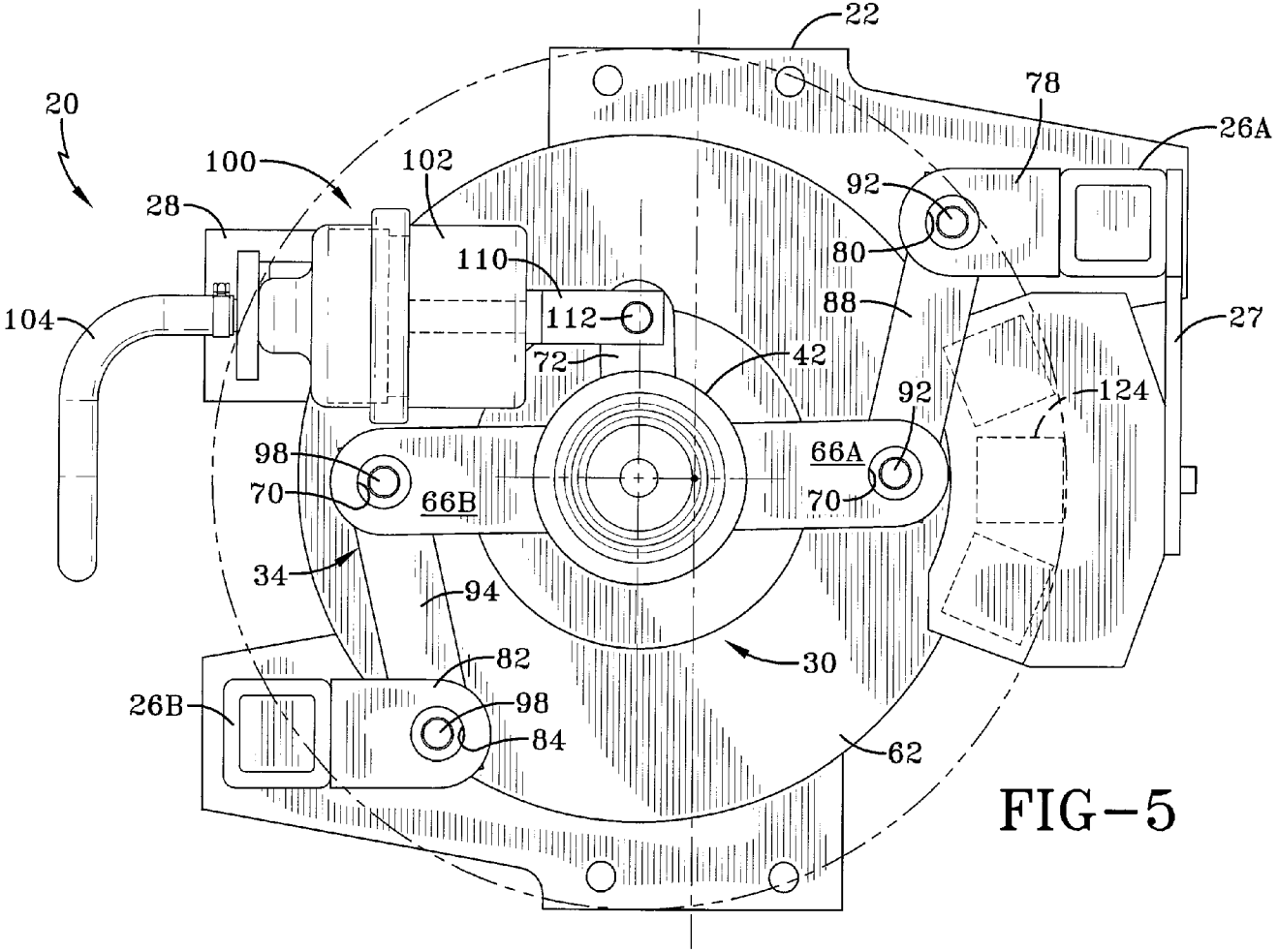
FIG. 5 is a front elevational view of the tension control device with the spool removed so as to show a straight-line mechanism which allows lateral movement of a spindle assembly into and out of relationship with an eddy current braking system according to the concepts of the present invention.
Figure 6:
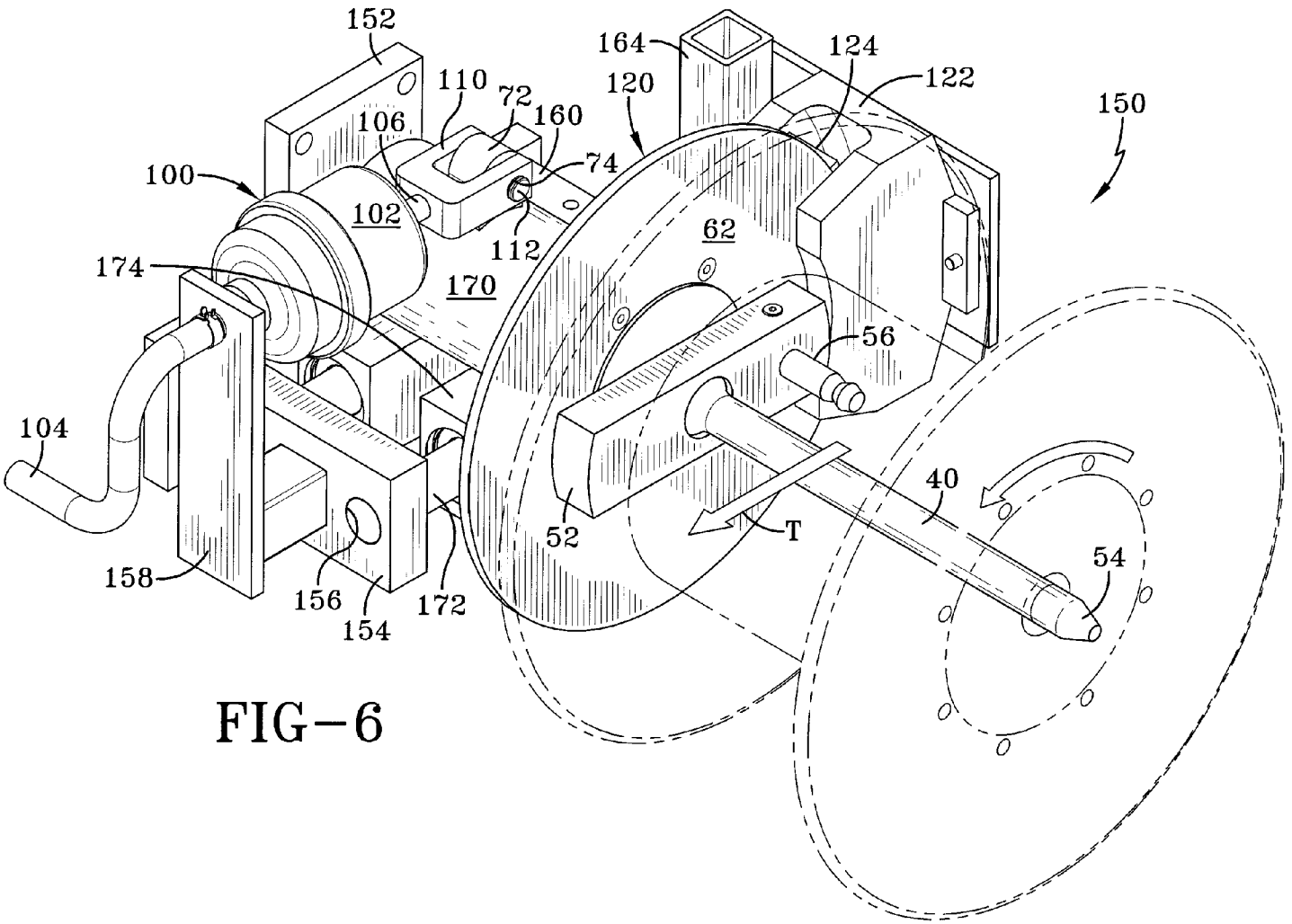
FIG. 6 is a front isometric view of an alternative self-compensating filament tension control device with eddy current braking shown in a braking position embodying the concepts of the present invention, wherein a spool of filamentary material is shown in phantom and wherein the device controls withdrawal tension of the filamentary material.
Figure 7:
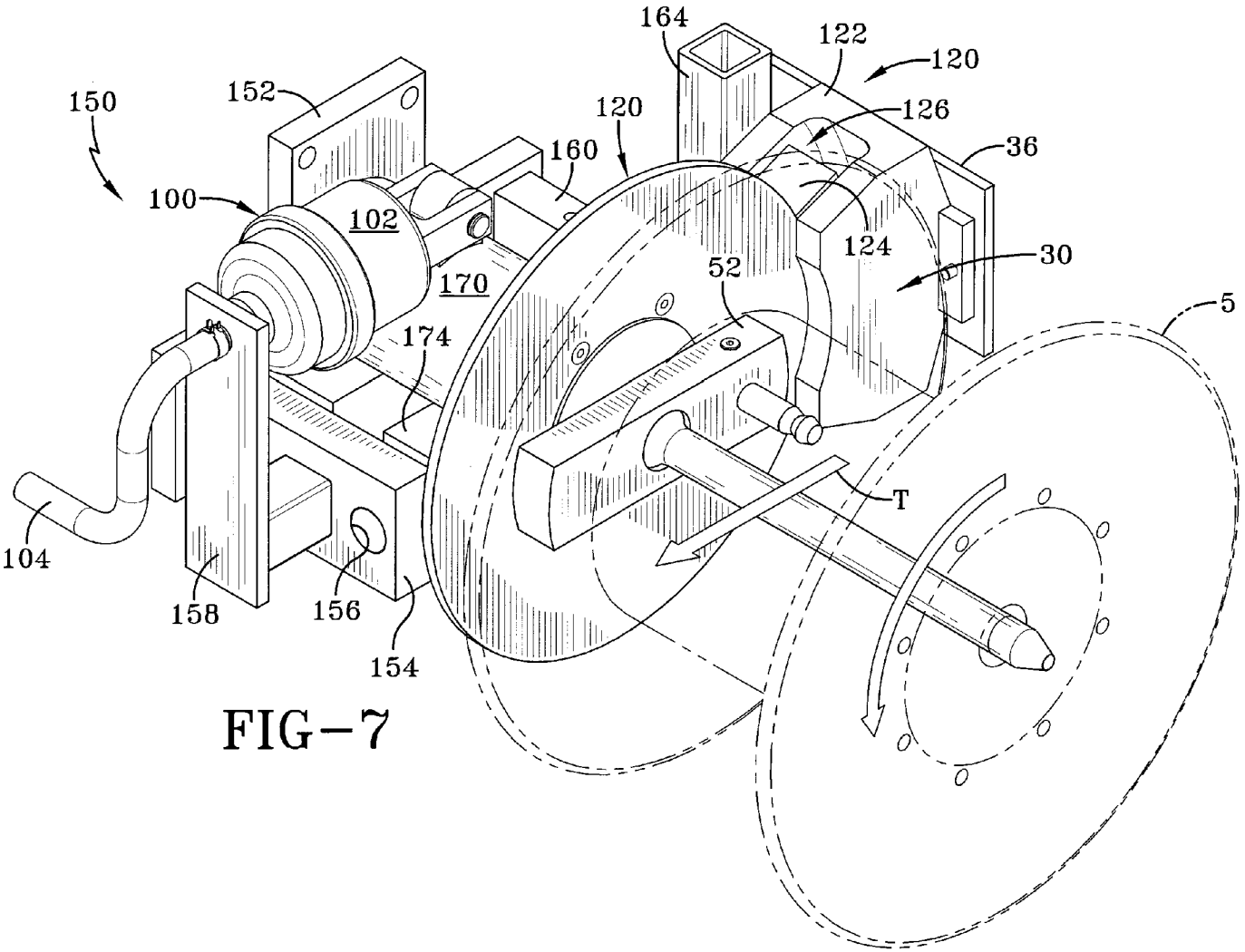
FIG. 7 is a front isometric view of the alternative tension control device showing the device in a non-braking position.

The spindle assembly 30 includes a spindle 40 which is rotatably received in a carriage 42 and which axially extends therefrom. As best seen in FIG. 4, bearings 44 are interposed between the spindle 40 and the carriage 42 to allow for rotatable movement of the spindle 40. As seen in FIGS. 1-3, the carriage 42 includes a brake end 46 and a spool end 48. At the spool end 48, a drive plate 52 is attached to and rotates with the spindle 40 which axially extends therethrough. The spindle has a tapered end 54 to allow for easy loading of the spool S. A drive pin 56 extends from the drive plate 52 in the same direction as the spindle and is radially displaced from the spindle 40. The drive pin 56 is received in an interior portion or hub of the spool and facilitates transfer of rotational and braking forces between the spool and the spindle assembly. In other words, as the filament is drawn or pulled off of the spool, as tension is applied, the rotational forces imparted to the spool are transmitted to the drive pin 56, the drive plate 52 and the spindle 40. Likewise, as will be described, braking forces applied to the spindle are transmitted through the drive plate, the drive pin and the spool to slow or stop rotation of the spool.

As best seen in FIG. 4, the spindle 40 extends through the carriage 42. A hub 58 is attached to the end of the spindle opposite the tapered end 54 and rotates therewith by virtue of a key 60. In other words, the key 60 interconnects the spindle 40 to the hub 58 so that as the spool rotates; the drive pin, the spindle, and the hub rotate in a corresponding manner.

A braking plate 62 is attached to the hub 58 and rotates as the spindle rotates. The braking plate 62 is constructed of an electrically conductive material and has a relatively large outer diameter in comparison to the hub 58. The braking plate 62 is also relatively thin and is provided with an outer diameter larger than the hub 58. The braking plate is constructed of an electrically conductive material such as copper although other electrically conductive materials could be utilized. Accordingly, rotation of the spool by the pull-off force of the filamentary material results in rotation of the drive plate and the spindle assembly which in turn rotates the braking plate 62.

As best seen in FIGS. 1-3 and 5, the carriage 42 includes a pair of spaced apart carriage arms 64 which extend from each side of the carriage. The carriage arms 64 are provided at front and rear ends of the carriage and suffixes are employed to designate which carriage arm is in proximity to other features of the tension control device. Specifically, a front carriage arm 66A is disposed near the brake side of the device while a front carriage arm 66B is disposed near the diaphragm side of the device. In a corresponding manner, a rear carriage arm 68A is near the brake side while a rear carriage arm 68B is near the diaphragm side. Carriage arms 66 and 68 are each provided with a carriage arm hole 70 extending therethrough. It will be appreciated that the carriage arms 66 and 68 extend in opposite directions from one another and are oriented about 180° apart. The carriage arms extend radially from the carriage 42 to become part of the straight line mechanism 34. Extending radially from a top side of the carriage 42 and approximately 90° away from either pair of carriage arms is a nose 72. Extending through the nose 72 is a nose hole 74.

The straight line mechanism 34 interconnects the carriage arms 64 to the support arms 26A and 26B. As will become apparent as the description proceeds, the straight line mechanism allows for linear movement of the spindle assembly 30. In particular, variations in a tension force applied to the filamentary material moves the spindle assembly 30 substantially horizontally and linearly side to side in relation to the fixed support. The straight line mechanism 34 includes a pair of upper arm tabs 78 which are spaced apart and extend substantially perpendicularly from the support arm 26A toward the carriage 42. Each tab 78 has a tab hole 80 extending therethrough which is aligned with one another. The mechanism 34 also includes a pair of spaced apart lower arm tabs 82 that extend substantially perpendicularly from the lower support arm 26B toward the carriage 42. Each tab 82 includes a tab hole 84 which is substantially aligned with one another.

Interconnecting the tabs 78 and 82 to the carriage arms 66B, 68B and 66A, 68A, are link arms. Specifically, an upper link arm 88 includes a pair of link arm holes 90 extending cross-wise through each end thereof. Each link arm hole 90 is aligned with the tab holes 80 and receives a link pivot pin 92 therethrough. The other end of the link arm 88 is connected to the carriage arms 66A and 68A wherein a pivot pin 92 extends through the corresponding link arm hole 90 and the arm holes 70. In a similar manner, a lower link arm 94 connects the carriage arms 66B and 68B to the tab arms 82. The link arm 94 has link arm holes 96 extending cross-wise through each end thereof. One link arm hole 94 is aligned with the carriage arm holes 70 so as to receive a pivot pin 98. The other end of the lower link arm 94 is connected to the lower arm tabs 82 and their respective tab holes 84 via a link pivot pin 98 which extends through the other link arm hole 96. Skilled artisans will appreciate that use of the link arms 88 and 94 to interconnect the carriage arms 66A,B and 68A,B to the upper and lower arm tabs 78 and 82 form the straight line mechanism 34 which allows for the spindle assembly 30 to move from side to side. It will further be appreciated that this movement is substantially linear.

A loading assembly 100 is utilized to generate a biasing force to initially position the linear relationship of the spindle assembly 30 with respect to the braking mechanism. In particular, the loading assembly includes a diaphragm 102 wherein one end is mounted to the diaphragm bracket 28. One end of an air tube 104 is connected to the diaphragm 102 and the opposite end is connected to a pressurized air system (not shown). A piston rod 106 extends from the end of the diaphragm 102 opposite the air tube and is connected to a clevis 110 which interfits with the nose 72. The clevis 110 has a nose end hole 114 which is aligned with the nose hole 74 wherein a clevis pin 112 extends through the nose end hole 114 and the nose hole 74 so as to connect the rod 106 to the carriage 42. A predetermined amount of pressure is applied via the air tube 104 through the diaphragm 102 so as to extend the piston rod 106 outwardly and move the spindle assembly 30 into a braking position as will be described. Other biasing forces could be generated by gravity or a tilted orientation of the spindle assembly and/or straight-line mechanism with respect to the fixed support.

A braking mechanism 120 is connected to and carried by the upper support arm 26A. In particular, a brake fixture 122 is carried by the support bracket 27. The fixture 122 includes magnetic material such as permanent magnets 124. The brake fixture includes a gap 126 that is formed between the magnets 124 and an edge of the brake bracket. The rotatable conductive member 62, which may also be referred to as a braking plate, is receivable within the gap 126 and is allowed to rotate therein. It will be appreciated that no surface-to-surface contact is made between the conductive member 62 and the magnets 124 or, for that matter, any portion of the braking mechanism 120.

In operation, after spool S is loaded onto the spindle assembly 30, and air pressure is applied to the loading assembly 100, the tension control device is ready to operate. The air pressure applied to the loading assembly 100 is such that the force delivered by loading assembly 100 is substantially equal to the withdrawal tension desired.

Initially, the straight-line mechanism 34 is biased by the force from the loading assembly 100 such that the rotatable conductive member 62 is at least partially disposed in proximity to the magnets 124. As a tension force is applied by the pulling of the filamentary material, the rotatable conductive member 62 rotates generating a magnetic field interacting with magnets 124 which creates a drag on the conductive member 62, and thereby creates a tension in the filamentary material. The tension created in the filamentary material opposes the bias force of the loading assembly resulting in the movement of the straight-line mechanism (with spindle assembly 30 and spool S) out of or away from the magnets 124 until the tension force of the filamentary material is substantially in balance with the force of the loading assembly 100. In other words, the filamentary material is allowed to payout or be withdrawn at a regulated rate when the biasing force exerted by the loading assembly or other force provided by configuration of the device 10 is equivalent to or balanced with the tension force applied to the filamentary material. As these forces counteract one another, the spindle assembly linearly moves in relation to the fixed support. In most embodiments the linear movement will be substantially horizontal, but could be in other orientations depending upon how the spindle assembly is oriented with respect to the fixed support.

If the speed of withdrawal of the filamentary material is changed, the movement of the straight-line mechanism (with spindle assembly 30 and spool S) adjusts automatically to the force delivered by the loading assembly 100 as long as the force of the loading assembly is within the operating limits of the device. To change operating tension of the filamentary material, it is only necessary to change the pressure applied to the loading assembly 100, or change the biasing force in another manner as appropriate.

Obviously, when the withdrawal speed is stopped, withdrawal tension falls to zero because spool S and spindle assembly 30 with conductive member 62 no longer rotate, and no retarding drag is generated. In other words, when the withdrawal speed is slowed, the tension force is reduced and unable to overcome the biasing force, and then the conductive member moves linearly toward a side-by-side relationship with the magnetic member resulting in generation of eddy currents and application of braking force.

Figure 3A:
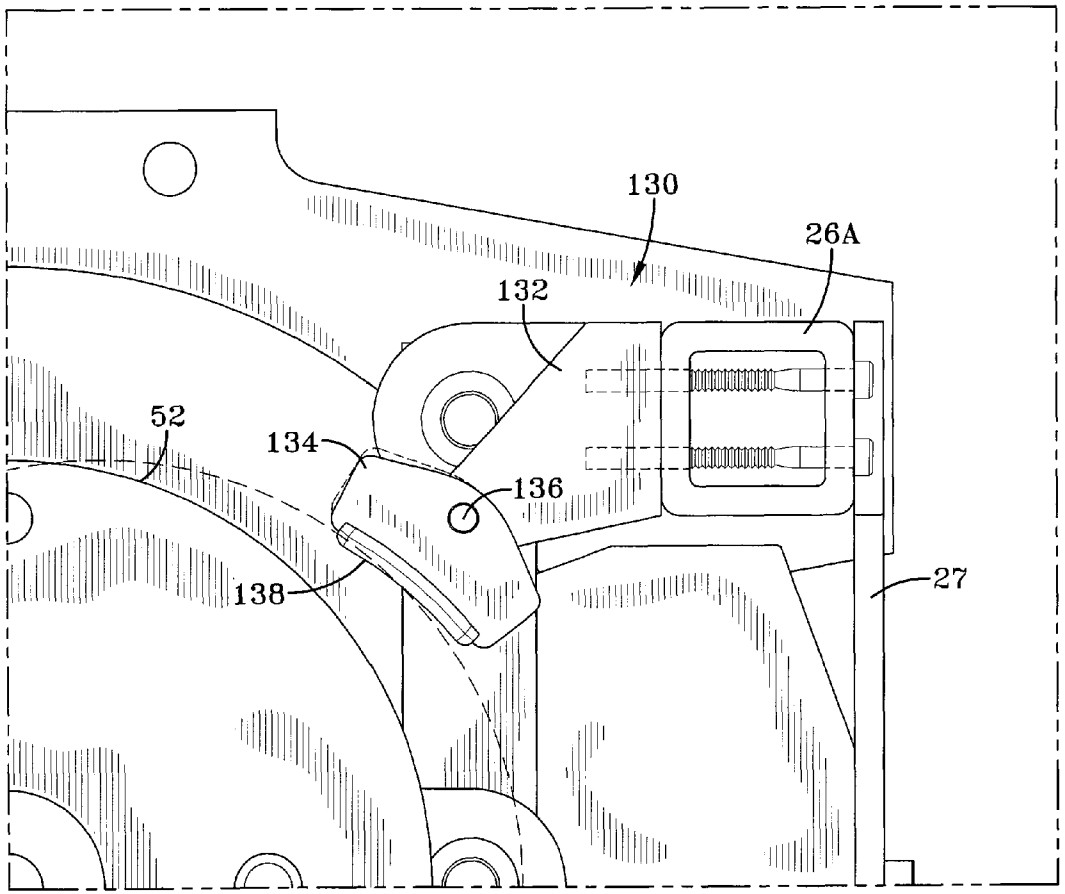
FIG. 3A is a partial front elevational view of the device, showing the supplemental brake according to the concepts of the present invention.

In some embodiments, it may be desirable to provide a supplemental braking force to fix the spindle assembly 30 to restrain rotation during loading of the spool on to the tension control device and/or during threading of the filamentary material into the appropriate fixture. As best seen in FIGS. 3 and 3A, a supplemental brake is designated generally by the numeral 130. The brake 130 is mounted to and carried by the support arm 26A. Brake 130 includes a bracket 132 extending from support arm 26A toward the drive plate 52. The bracket 132 pivotably carries a brake shoe 134 via a pin 136. The pivotable movement of the brake shoe accommodates the linear movement of the spindle assembly 30. The shoe 134 includes a wear surface 138 that bears against the outer circumference or other appropriate surface of the drive plate 52 when the action of the loading assembly 100 is unopposed by any other forces.

Specifically, when withdrawal of the filamentary material is stopped, generation of the drag force ceases, and the loading assembly 100 causes the spindle assembly 30 to shift to full engagement with the magnets while simultaneously bearing upon mechanical brake shoe 134, thereby tending to restrain rotation of the spindle. If conditions warrant doing so, the applied force from the loading assembly can be increased during the stopped condition so as to increase the mechanical braking force. Use of the supplemental brake 130 facilitates operation and use of the device 20.

Skilled artisans will appreciate that the straight-line mechanism eliminates the effect of gravity except for the friction, which varies according to the weight of the spool, but is negated by the use of anti-friction bearings in the joints. This embodiment is further advantageous in that the need for a control arm is eliminated, thus avoiding potential problems with wear on a control arm used in the prior art and tangling of filamentary material that is laced through the control arm.

Referring now to FIGS. 6-10, it can be seen that an alternative embodiment of the tension control device is shown. In this embodiment the straight-line mechanism is replaced with a linear ball bushing mechanism which also allows for linear movement of the carriage assembly based upon the pull-off forces exerted by the filamentary material. Other than the specific operational features of the ball bushing mechanism replacing the straight-line mechanism, the alternative embodiment operates in substantially the same manner. And all of the parts are substantially the same except for replacement of the straight-line mechanism. Where appropriate, the same identifying numerals are used for the same components and those features are incorporated into the present embodiment. In this embodiment, the device 150 includes a support frame 152 which carries a linear ball bushing mechanism designated generally by the numeral 153. The support frame is fixed to the creel structure as in the previous embodiment. A pair of spaced apart support arms 154 and 160 extend from the support frame 152 in a substantially perpendicular and spaced apart manner. Each support arm 154,160 has at least one opening and in the embodiment shown a pair of rail openings 156 and 162, respectively, that are aligned with one another.

A diaphragm bracket 158 extends from the support arm 154 and carries the loading assembly 100 which operates as described in the previous embodiment. A brake bracket 164 extends from the support arm 160 and carries the magnets 124 utilized by the braking mechanism 120.

In this embodiment a carriage 170 is employed which is slidably mounted upon slide rails 172 that extend between the support arms 154 and 160. Specifically, the slide rails 172 are carried and mounted in the rail openings 156 and 162. The carriage 170 includes two pairs of carriage bushings 174 that are mounted to an underside thereof and which slidably receive the slide rails 172. In other words, one pair of carriage bushings 174 is associated with each of the slide rails 172. Of course, any number of carriage bushings can be associated with each slide rail. As such, the carriage 170 moves linearly along the slide rails 172 depending upon the tension force applied by the filamentary material and the biasing force applied by the loading assembly.

As will be appreciated upon viewing FIGS. 6-10, the rotatable conductive member 62 is carried by the hub 58 that rotates as the spindle rotates and is mounted in proximity to the spool end of the carriage. Moreover, the brake mechanism 120, including the brake fixture 122, is mounted proximal the drive plate 52. Skilled artisans will appreciate; however, that the braking mechanism 150 could be placed on the other side of the carriage 170 if desired, as long as the conductive member is likewise moved to the same side of the carriage.

Operation of the ball bushing embodiment of the device 150 is similar to that of the device 20 and those operational features are adopted. As a tension force is initially applied to the filamentary material, the loading assembly 100 or other structural feature exerts a bias force to maintain the carriage 170 and the rotating conductive member 62 in close proximity to the braking mechanism. As the biasing force is overcome, the tension on the filamentary material pulls the spindle assembly away from the braking mechanism in a substantially horizontally and linear direction and the spool is allowed to rotate without a braking force applied. In the event the tension or force on the filamentary material is suddenly released and the spool continues to rotate, then the loading assembly 100 pushes the carriage assembly 170 horizontally and linearly back toward the braking mechanism and the rotating conductive member is directed toward the gap 126 and placed in proximity to the magnets. At this time, eddy currents are generated in the conductive member and a corresponding braking force is generated so as to slow or stop the rotation of the spindle and accordingly the spool.

Figure 8:
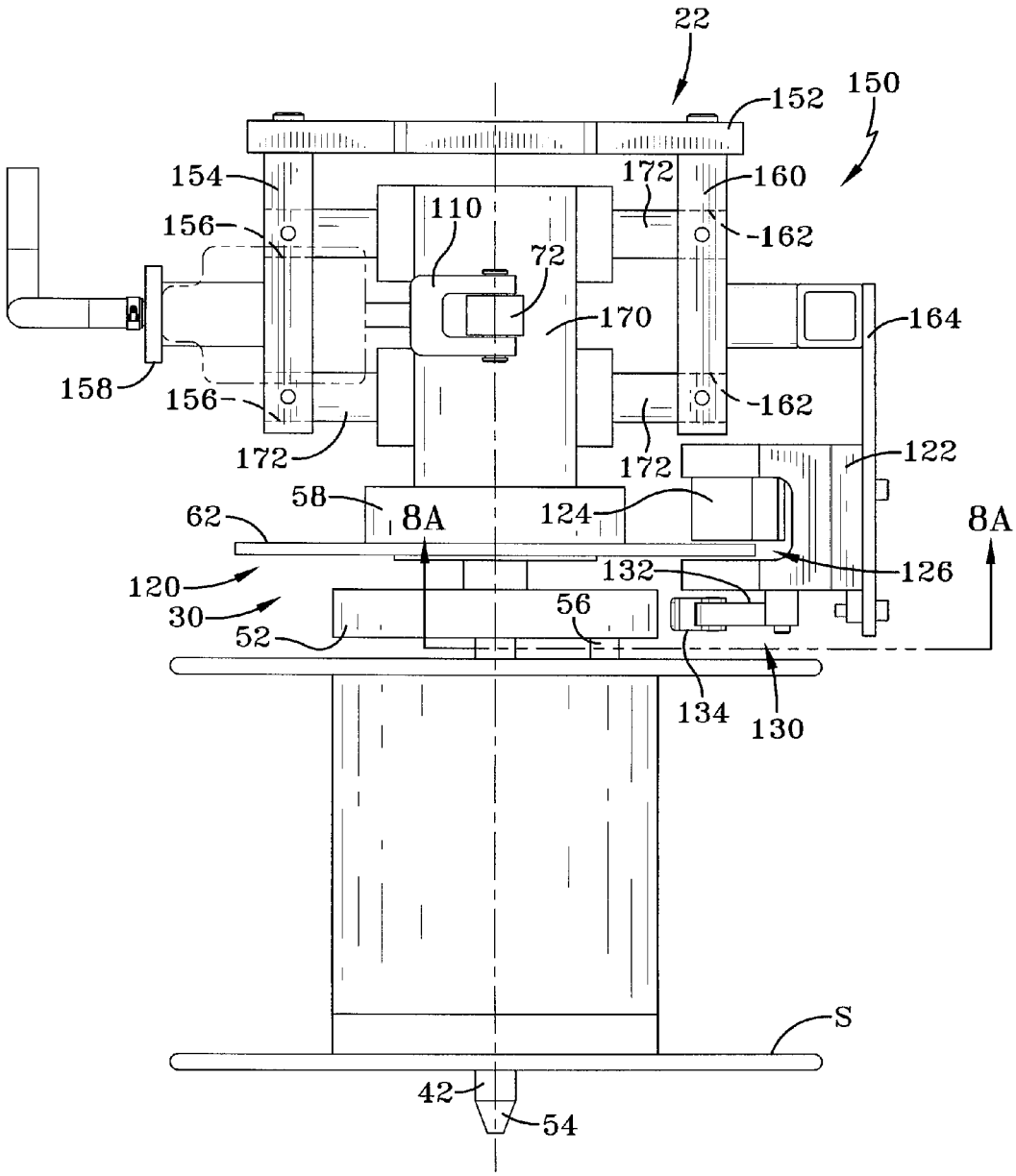
FIG. 8 is a top view of the alternative tension control device which includes a supplemental brake.
Figure 8A:
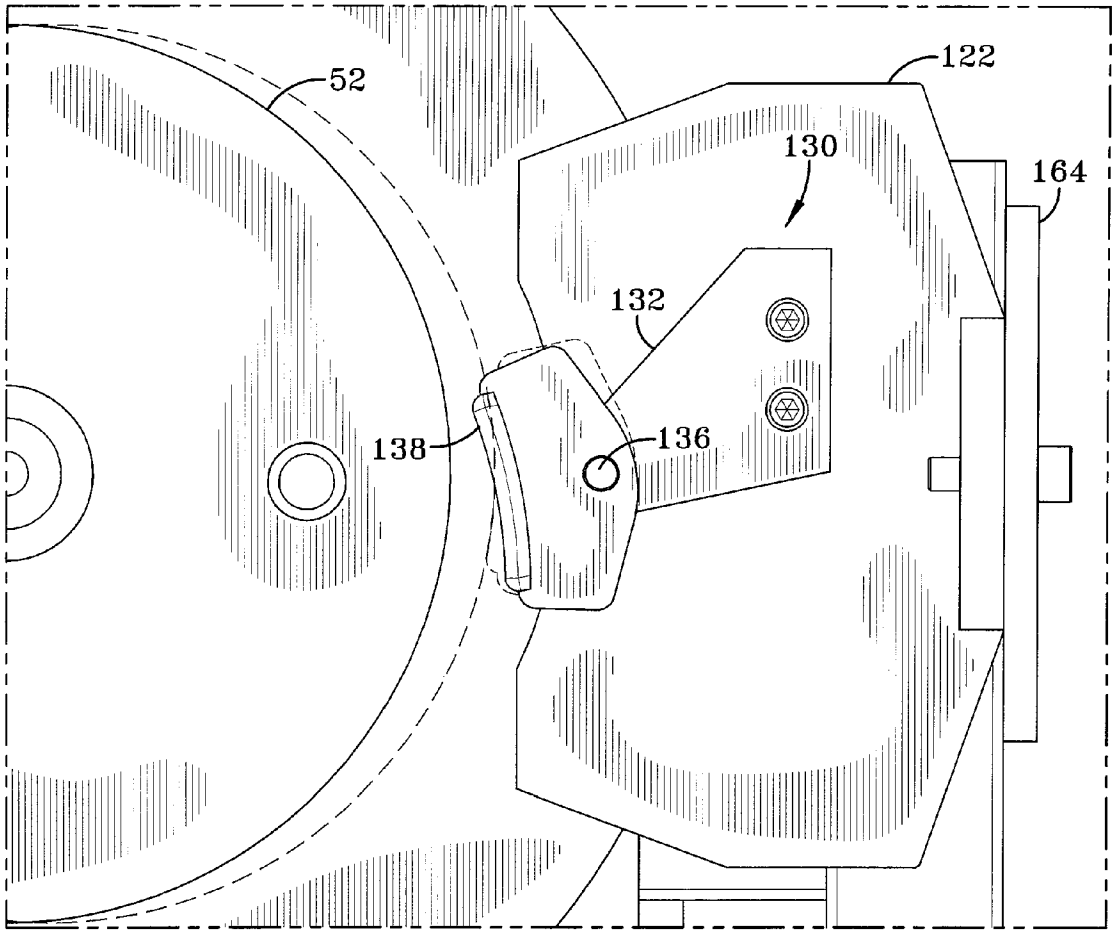
FIG. 8A is a partial front elevational view of the alternative device, showing the supplemental brake according to the concepts of the present invention.
Figure 9:
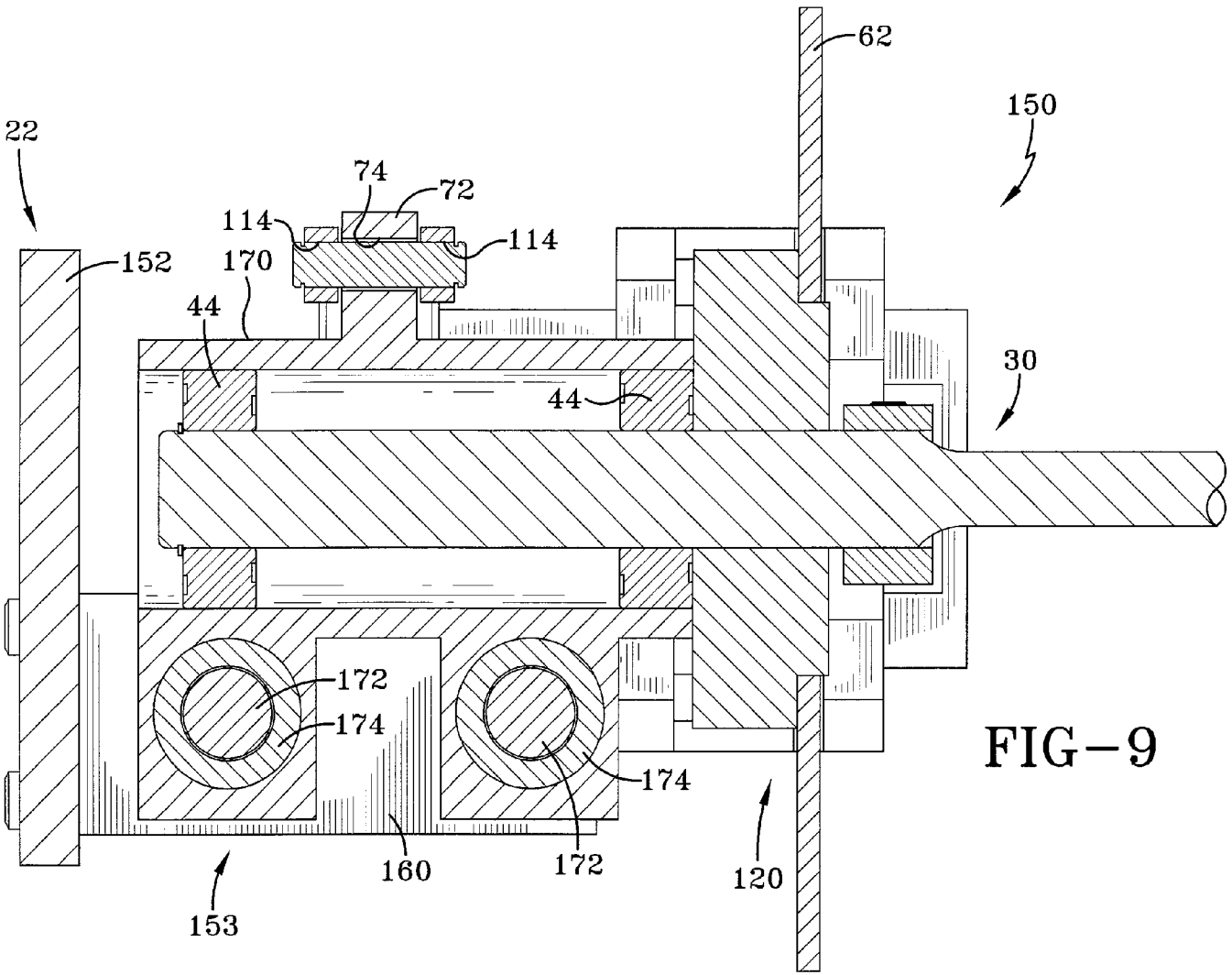
FIG. 9 is a partial cross-sectional view of the alternative tension control device.
Figure 10:
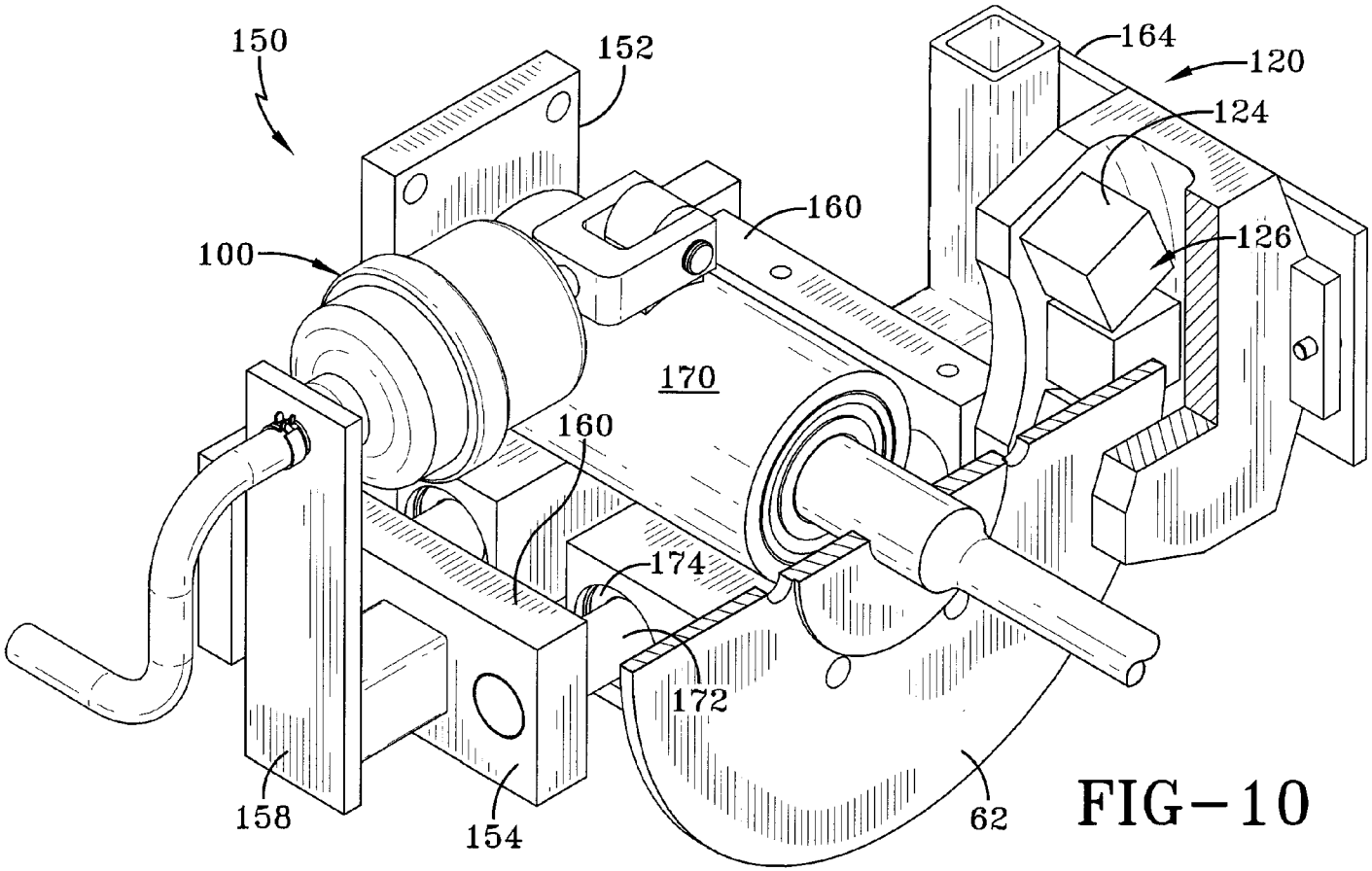
FIG. 10 is a front isometric view of the tension control device, partially broken away, showing elements of the eddy current braking system and a linear ball bushing mechanism which allows lateral movement of a spindle assembly into and out of relationship with an eddy current braking system according to the concepts of the present invention.

In the alternative embodiment, the supplemental brake 130 may also be used. As best seen in FIGS. 8 and 8A, the brake 130 is mounted to and carried by the brake fixture 122 and operates in substantially the same manner as described in the embodiment shown in FIGS. 3 and 3A.

It will be appreciated that the device 150 has many of the same benefits and advantages of the device 20. Although the ball bushings are of low friction, they do have sufficient friction to interfere with the function of heavy spool loads in view of the deflection of the slide rails. However, the device may be beneficial for use with light weight spools of filamentary material.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A self-compensating tension control device for regulating the payout of filamentary material from a spool, comprising:

a fixed support;

a spindle assembly carried by said fixed support, said spindle assembly rotatably carrying the spool of filamentary material;

a mechanism coupling said fixed support to said spindle assembly to allow said spindle assembly to move substantially horizontally and linearly depending upon a tension force applied to the filamentary material, in opposition to a biasing force, which causes said spindle assembly to linearly move in relation to said fixed support; and an eddy current braking system comprising a conductive member rotatable with said spindle assembly and a magnetic member carried by said fixed support, said spindle assembly and conductive member moving linearly toward a side-by-side relationship with said magnetic member when the tension force applied to the filamentary material is reduced and unable to overcome the biasing force, and wherein payout of the filamentary material at a regulated rate occurs when the biasing force is balanced with the tension force.

2. The device according to claim 1, wherein said mechanism comprises:

a straight-line mechanism coupling said fixed support to said spindle assembly.

3. The device according to claim 2, wherein said spindle assembly comprises a spindle rotatably received within a carriage, said carriage having a pair of spaced apart carriage arms extending radially from opposite sides of said carriage, each said carriage arm having a carriage arm hole therewith, and wherein said fixed support comprises:

a support frame;

an upper support arm extending from one side of said support frame; and a lower support arm extending from another side of said support frame;

each said support arm having spaced apart arm tab holes aligned with each other.

4. The device according to claim 3, wherein said straight line mechanism further comprises:

a first link arm pivotably connecting said upper support arm with one said pair of said carriage arms; and a second link arm pivotably connecting said lower support arm with the other of said pair of said carriage arms.

5. The device according to claim 4, wherein said carriage has a brake end that carries said conductive member and a spindle end from which extends said spindle, said spindle end having a drive pin extending in the same direction as said spindle, said drive pin adapted to be engaged by the spool such that rotation of the spool causes rotation of said conductive member.

6. The device according to claim 5, further comprising:

a brake fixture carried by one of said support arms, said brake fixture carrying said magnetic member.

7. The device according to claim 2, further comprising:

a loading assembly mounted to said fixed support and coupled to said spindle assembly so as to impart the biasing force to said spindle assembly to cause positioning of said rotatable member toward the side-by-side relationship.

8. The device according to claim 7, further comprising:

a supplemental brake mounted to said fixed support and having a brake shoe;

a spindle and a drive plate rotatably carried by said spindle assembly, wherein the spool is rotatably received on said spindle; and a supplemental brake mounted to said fixed support and having a brake shoe, said loading assembly forcing said drive plate into contact with said brake shoe thereby restraining rotation of said spindle when there is no tension force applied to the filamentary material.

9. The device according to claim 1, wherein said mechanism comprises:

a ball bushing mechanism coupling said fixed support to said spindle assembly.

10. The device according to claim 9, wherein said spindle assembly comprises a spindle rotatably received within a carriage, said carriage having at least one carriage bushing mounted thereto, and wherein said fixed support comprises opposed support arms, each support arm having at least one rail opening aligned with one another, and at least one slide rail having opposed ends received in said rail openings.

11. The device according to claim 10, wherein said at least one slide rail is slidably received in said at least one carriage bushing.

12. The device according to claim 11, wherein said conductive member and said spindle extend from said carriage, said carriage also maintaining a drive pin extending in the same direction as said spindle, said drive pin adapted to be engaged by the spool such that rotation of the spool causes rotation of said conductive member.

13. The device according to claim 12, further comprising:

a brake fixture carried by one of said opposed support arms, said brake fixture carrying said magnetic member.

14. The fixture according to claim 9, further comprising:

a loading assembly mounted to said fixed support and coupled to said spindle assembly so as to impart the biasing force to said spindle assembly to cause positioning of said rotatable member toward said side by side relationship.

15. The device according to claim 14, further comprising:

a supplemental brake mounted to said fixed support and having a brake shoe;

a spindle and a drive plate rotatably carried by said spindle assembly, wherein the spool is rotatably received on said spindle; and a supplemental brake mounted to said fixed support and having a brake shoe, said loading assembly forcing said drive plate into contact with said brake shoe thereby restraining rotation of said spindle when there is no tension force applied to the filamentary material.

* * * * *